US005335915A

United States Patent [19]

Baudier

[11] Patent Number: 5,335,915

[45] Date of Patent: Aug. 9, 1994

[54] GOLFER'S STANCE GAUGE

[76] Inventor: Albert J. Baudier, 5106 Montegut, New Orleans, La. 70126

[21] Appl. No.: 36,954

[22] Filed: Mar. 25, 1993

[51] Int. Cl.[5] ..... A63B 69/36

[52] U.S. Cl. ..... 273/187 R

[58] Field of Search ..... 273/187 R, 187 A, 187 B, 273/187.1, 187.2; 434/252

[56] References Cited

U.S. PATENT DOCUMENTS

| | | | |
|---|---|---|---|
| 3,658,344 | 4/1972 | Kimble | 273/187 R |
| 4,434,983 | 3/1984 | Taggart | 273/187 R |
| 4,538,815 | 9/1985 | Poirier | 273/187 R |

FOREIGN PATENT DOCUMENTS

| | | | |
|---|---|---|---|
| 16930 | of 1911 | United Kingdom | 273/187 R |

*Primary Examiner*—George J. Marlo

[57] ABSTRACT

A new and improved golf stance training tool designed to insure a golfer's consistently correct stance in relation to both the ball to be struck and the desired target for every different golf club comprising:

(a) a base plate in the shape of a non-adjustable arch bearing pre-calibrated foot placement indicia, as determined by a golfer's shoulder width, along with pre-calibrated club selection indicia representing correct club placement for each different club between those foot placement indicia for both right and left-handed golfers;

(b) a first club selector gauge member adjustably connected to said base plate and bearing pre-calibrated indicia representing the proper distancing of golf ball away from the feet for each different golf club and having ball placement indicator arrows positioned on its top edge so as to not interfere with the clubhead path, said arrows being spaced apart and indicating proper ball placement for both right and left-handed golfers, (c) a second target arrow pointer member being perpendicularly mounted to said first club selector gauge member so as to indicate the target line for both right and left-handed golfers.

2 Claims, 5 Drawing Sheets

GOLFER'S STANCE GAUGE

BACKGROUND OF THE INVENTION

1. Field of the Invention

This invention relates to golf stance devices generally and more particularly to devices designed to assure a golfer's correct and consistent alignment in relation to the golf ball and his target.

2. Discussion of Related Art

U.S. Pat. No. 4,257,608 to C. R. Frank describes a golfer's setup device consisting of a lateral scale strip with two short foot-aligning strips, one being pivotally secured near one end of the lateral strip and the other being slidably and pivotally mounted to slide along and pivot with respect to the lateral strip. A perpendicular scale strip is mounted to the lateral scale strip to allow non-pivotal sliding both laterally and perpendicularly. An additional club-swing aligning strip can be pivotally mounted to one end of the perpendicular scale strip, and arrows on the pivotal foot-aligning strips indicate the direction in which the golfer's shoes are to point.

U.S. Pat. No. 4,322,084 to C. L. and G. L. Reece describes a golf stance machine consisting of a longitudinally extending mainframe composed of a rectangular tubular member. One foot stance indicator is permenantly fixed obliquely to the main frame for positioning of the forward foot. A second adjustable foot-placement indicator slides longitudinally along the main frame. Additional graduated bars indicating forward and backward swing lines are mounted parallel to the main frame.

U.S. Pat. No. 4,538,815 to R. G. Poirier describes a golfer's stance guage comprising a longitudinally adjustable foot positioning frame which is adapted to be secured to the ground. A longitudinally adjustable ball marker member is pivotally connected to the foot positioning frame along the axis of the intended ball position for the driver club. A second ball marker member is mounted slidably along the first ball-marker member, extending outward therefrom at right angles. Markings are recorded on these members for locating proper ball position relative to foot position for different clubs. These markings must be applied by the golfer following a trial-and-error calibration technique.

Other known patents of interest include U.S. Pat. No. 4,384,718.

It is an object of this invention to provide a new and improved golf stance training tool.

It is another object of this invention to provide a golf stance training tool having simplified markings corresponding to the correct adjustment position for each club and requiring no calculations or calibrations by the golfer prior to, or during, use, other than determining the golfer's shoulder width.

It is still another object of this invention to provide a golf stance training tool having a non-adjustable base plate with foot restrictors and markings for placement of feet in relation to shoulder width.

It is yet another object of this invention to provide a golf stance training tool having a target arrow fixed permanently perpendicular to the club selection guage and, therefore, parallel to the base plate to insure that the golfer's feet are consistently parallel to the target line.

It is a further object of this invention to provide a golf stance training tool having ball placement indicators arranged in such a way as to direct correct ball placement without hindering clubhead path nor requiring movement of any part of the device before swinging the club.

It is yet another object of this invention to provide a golf stance training tool which, due to its simplicity of adjustment and mobility, can be used simultaneously by both right and left handed golfers, golfers using different clubs, golfers of various sizes, and which can be easily relocated to a fresh piece of turf after each swing.

SUMMARY OF THE INVENTION

This golf stance training tool is designed to insure consistently correct placement of the golfer's feet in relation to both the ball and the desired target area. The device controls this foot placement in the aspects of placing the ball at the correct distance from the golfer's body for each different club, spacing the ball properly between the front and back feet, and positioning the golfer's feet parallel to the target line, thereby insuring a proper "aim."

The device consists of two flat, elongated pieces fabricated from high density plastic, or any similar material, about ⅛ inch thick. One piece, the base plate, measures 30" longitudinally and 11¾" latitudinally overall. This plate is designed in a squared-off arch shape for positioning the feet within a restricted area. The longitudinal portion of the arch is calibrated on the inside with a series of markings indicating correct foot positioning as determined by the golfer's shoulder width. The outer edge of the longitudinal portion of the base plate is calibrated with markings indicating positioning for each club—driver through sand wedge—for both left and right handed golfers. In the upper left corner of the base plate are printed instructions for proper use of the tool. In the upper right corner is a printed club guide which instructs golfers as to proper club selection.

The second piece, the club selection guage, consists of a cross-shaped piece whose vertical part measures 26" long and 2" wide. This vertical strip is calibrated with markings for club selection which correspond to the club selection markings on the outer edge of the base plate. The horizontal crossmember of the club selection guage, measuring 12" long and 2" wide, is fixed perpendicularly to the vertical strip. The horizontal crossmember indicates the proper swing plane and points toward the desired target. A portion of the vertical strip extends beyond the horizontal crossmember and is marked to indicate ball placement.

Both the base plate and the club selection guage are slotted lengthwise. These slots allow the attachment of the club selection guage to the base plate by means of a single bolt which passes through both slots and is fastened by a wing nut. By the loosening of this wing nut, the golfer can slide the club selection guage both horizontally and vertically in relation to the base plate along the respective slots. The golfer simply has to line up the club indicator line on the club selection guage with the corresponding line on the base plate, depending on which club the golfer intends to swing. The wing nut is tightened when the training tool has been set to the proper position for the desired club. This form of assembly also allows the folding of the device for compact storage.

DETAILED DESCRIPTION OF THE PREFERRED EMBODIMENT

Figure 1:
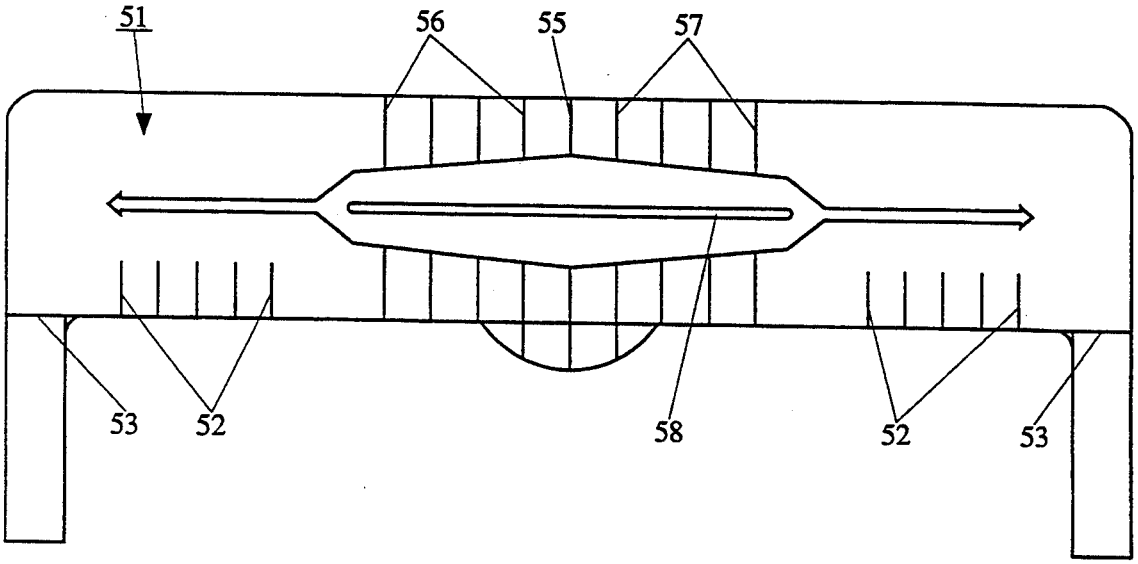
FIG. 1 is a perspective view of the base plate, showing the markings for club selection and foot placement.

Now referring to the drawings, a golf stance training tool incorporating the principles and concepts of the present invention and identified generally by reference number 50 will be described in detail.

FIG. 1 illustrates the first main component of the stance training tool 50, namely, the base plate 51. Base plate 51 is designed in an arch shape measuring 30" wide overall. The sides of the arch extend downward from the main body of the base plate as strips approximately 1½" wide and 5¾" long. These side "walls" or strips of the arch serve to confine the area within which the golfer must place his feet when setting up for a shot. Along the inside edge of the base plate 51 on both right and left sides is a series of short line markings 52, spaced one inch apart and labelled consecutively: 16", 18", 20", 22", and 24". These markings indicate proper placement of the toes of the right and left feet as determined by the golfer's shoulder width. The inside edge of the base plate 51 is also marked with a horizontal line 53 which extends across the entire width of the base plate 51. This line 53 is labelled the Toe and Shoulder Line and provides a reference for the golfer to align his toes and shoulders parallel to the base plate 51 and target arrow 54. In the vertical center of the base plate 51 is marked a single vertical line 55 which extends from the outside edge to the inside edge of the base plate 51. This line 55 is labelled WEDGE on either side and serves to indicate club selection position for the wedge club for both right and left-handed golfers. On the left side of the wedge line 55 is a series of four additional vertical lines 56 which run parallel to the wedge line 55 and are spaced 1¼" apart. These parallel lines 56 are labelled consecutively, from left to right: DRIVER, 3 WOOD LONG IRONS, MID-IRONS, and SHORT IRONS. These four lines 56 to the left of the wedge line 55 are collectively called the right-handed club selector markings, because they indicate correct position, with respect to each named club, for the right-handed golfer. Base plate 51 also includes four additional vertical lines 57 running parallel and to the right of the wedge line 55 which mirror the right-handed club selector markings and are identically labelled. These four lines 57 are collectively called the left-handed club selector markings, because they indicate proper position for each named club for left-handed golfers. Base plate 51 further includes a slot 58 measuring ¼" wide and 11" long, running horizontally and spaced equidistant from both the outside and inside edges of the base plate 51. In the upper left corner of the base plate 51 are printed the following Instructions for proper adjustment and use of the training tool 50:

INSTRUCTIONS

Loosen adjustment bolt. Set PROSTANCE for club to be used and retighten.

Place PROSTANCE on the ground and align arrow at target.

Place ball about three to four inches from ball pointer.

Place right and left feet on marks for shoulder width. If your shoulder width is 18 inches, place the toe of your right foot at the 18" mark on the right side and your left foot on the 18" mark on the left side.

With club in hand, square shoulders with Toe and Shoulder Line.

Now you are in the proper position for hitting the ball.

In the upper right corner of the base plate 51 will be printed the following Club Guide, showing which clubs correspond to the respective club selector markings 56 and 57:

CLUB GUIDE

WEDGE - WEDGE
SHORT IRONS - 8-9
MID IRONS - 5-6-7
LONG IRONS - 2-3-4
DRIVER - DRIVER

Figure 2:
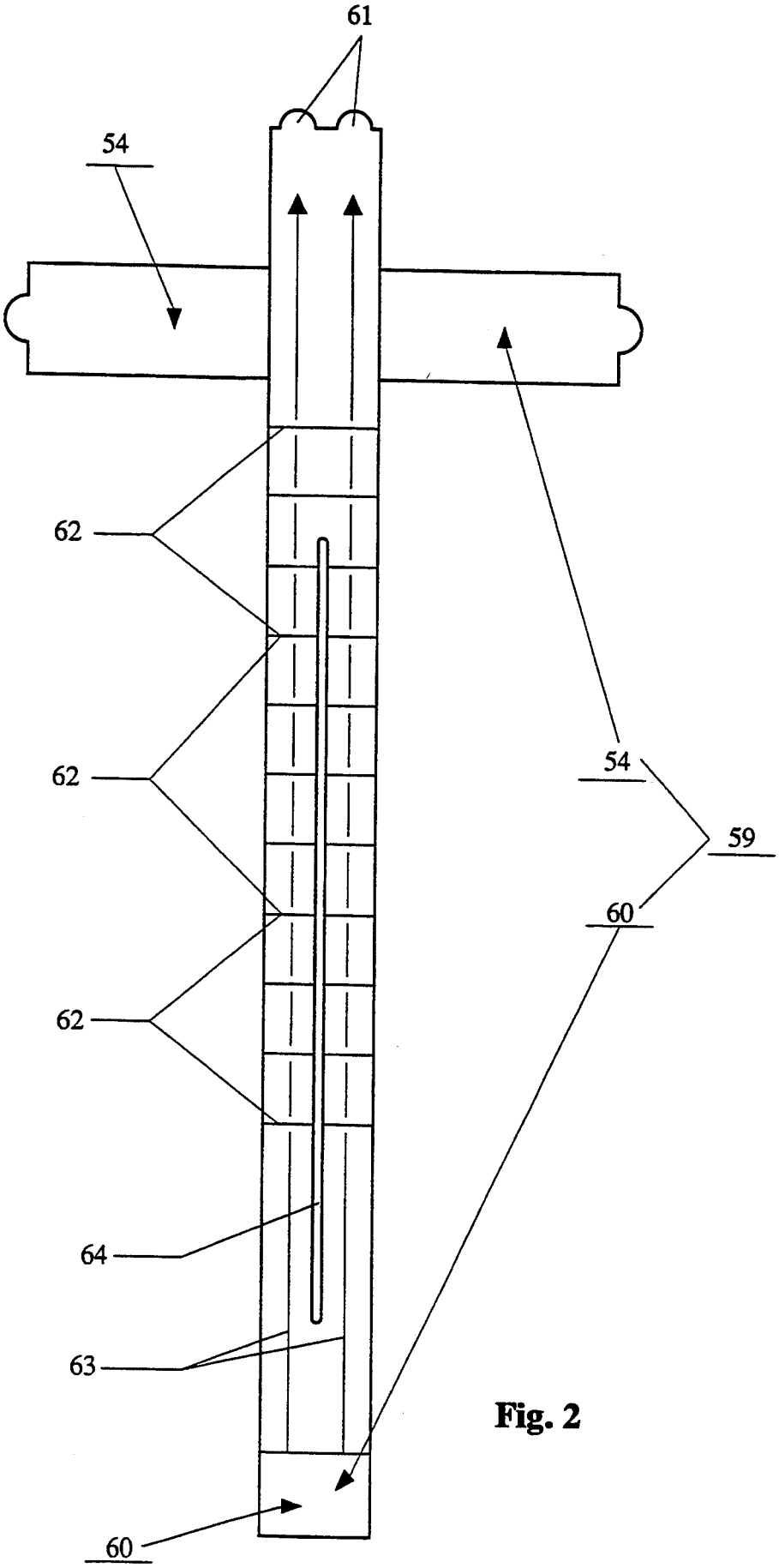
FIG. 2 is a perspective view of the assembled club selector guage, indicating club selection markings which correspond to those of the base plate and also showing the target arrow and ball placement indicators.

FIG. 2 illustrates the second main component of the training tool 50, namely, the club selector guage 59. The club selector gauge is further broken down into two pieces: the selection gauge 60 and the target arrow 54. The selection gauge 60 measures 26" long and 2" wide. At the top end of the selection gauge 60 are two ball pointers 61. The left ball pointer indicates proper ball placement for right-handed golfers and the right ball pointer indicates proper ball placement for left-handed golfers. Starting at 6" from the top of the selection gauge 60 is a series of eleven horizontal line markings 62. These eleven lines are spaced 1¼" apart and are labelled consecutively from top to bottom: WEDGE, NINE, EIGHT, SEVEN, SIX, FIVE, FOUR, THREE, TWO, 3 WOOD, and DRIVER. These line markings 62 are collectively called club selector markings and they correspond to the club selector markings 56 AND 57 on the base plate 51. The selection gauge 60 also contains two vertical aligning lines 63, which run along the length of the selection gauge 60 at approximately ½" from the left and right side edges respectively. The left aligning line 63 extends up to the left ball pointer 61 and is designed to line up with the appropriate right-handed club selector marking 56 on the base plate 51. The right aligning line 63 extends up to the right ball pointer 61 and is designed to be lined up with the appropriate left-handed club selector marking 57 on the base plate. Selection gauge 60 further contains a vertical slot 64 measuring ¼" wide and 14" long. This vertical slot 64 runs down the center of the selection gauge 60, starting 8" from the top end and stopping 4" from the bottom end.

The second piece comprising the club selector gauge 59 is the target arrow 54, measuring 12" long and 2" wide. The target arrow 54 is mounted perpendicularly to the selection guage 60 at 3" from the top edge of the selection gauge 60. The mounting is done by rivets Bolts and nuts. The target arrow points to the left for right-handed golfers and to the right for left-handed golfers, and is labelled accordingly.

Figure 3:
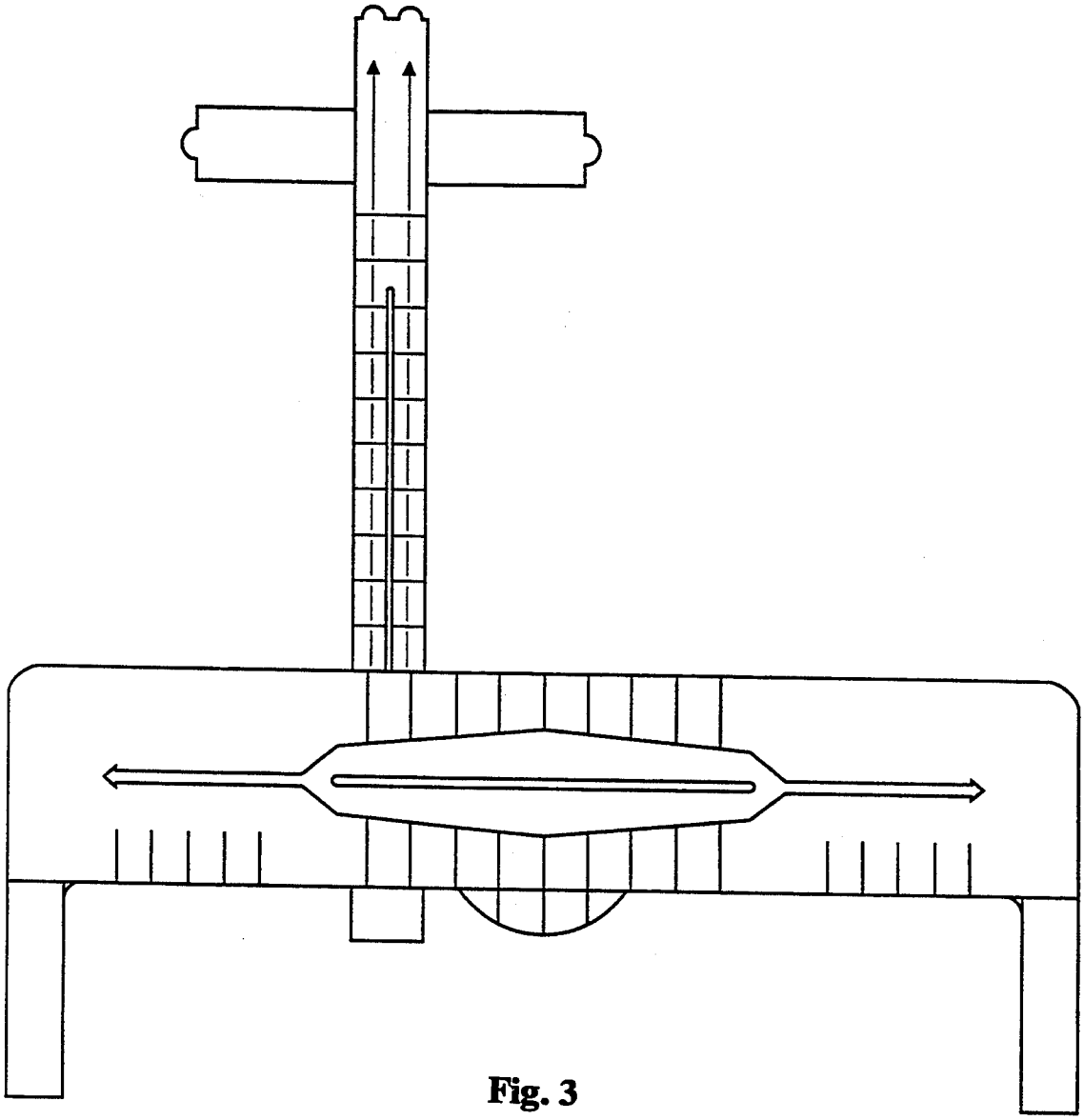
FIG. 3 is a plan view of the assembled invention illustrating a proper setup for a right-handed golfer to affect a shot with the driver.
Figure 4:
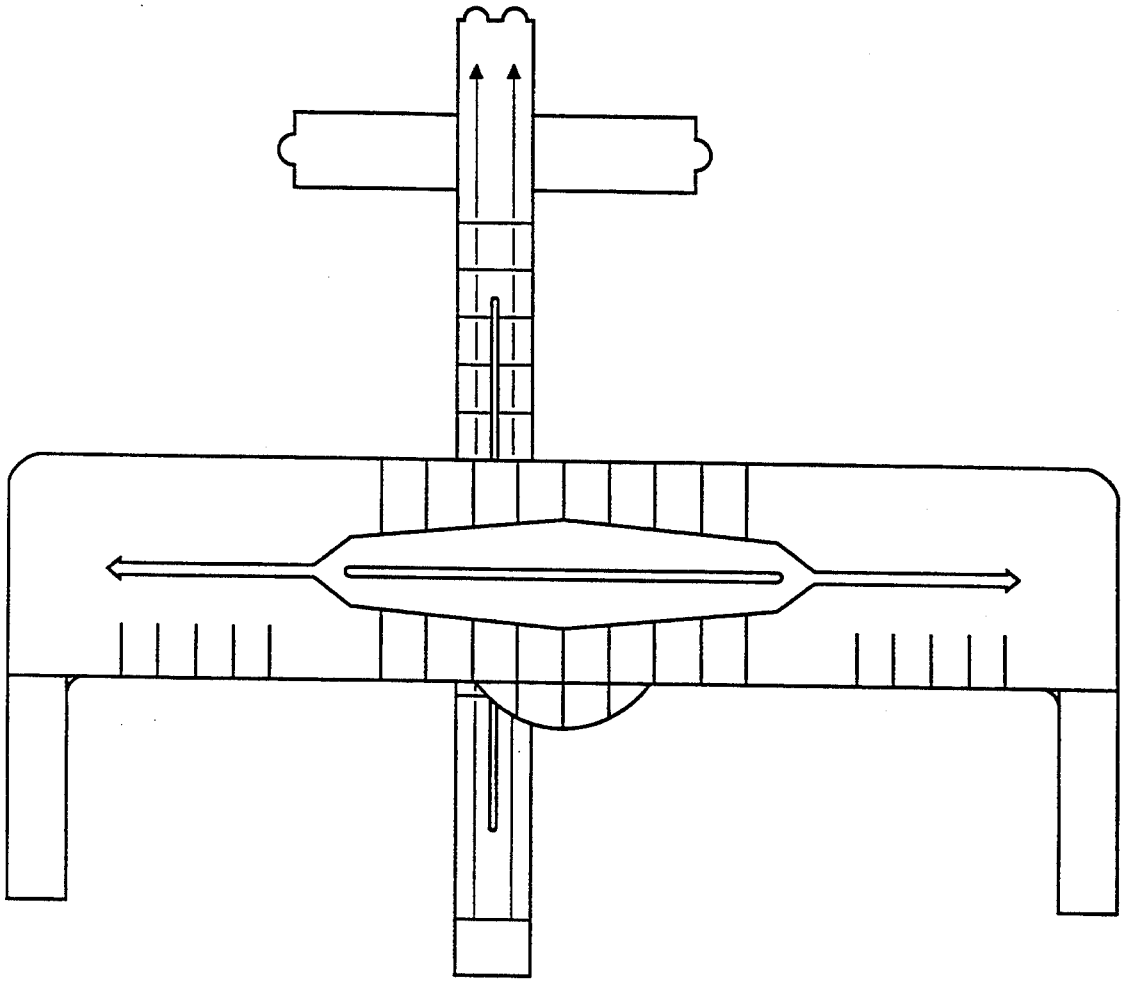
FIG. 4 is a plan view of the assembled invention illustrating a proper setup for a right-handed golfer to affect a shot with the mid-range irons (5, 6, and 7 irons).
Figure 5:
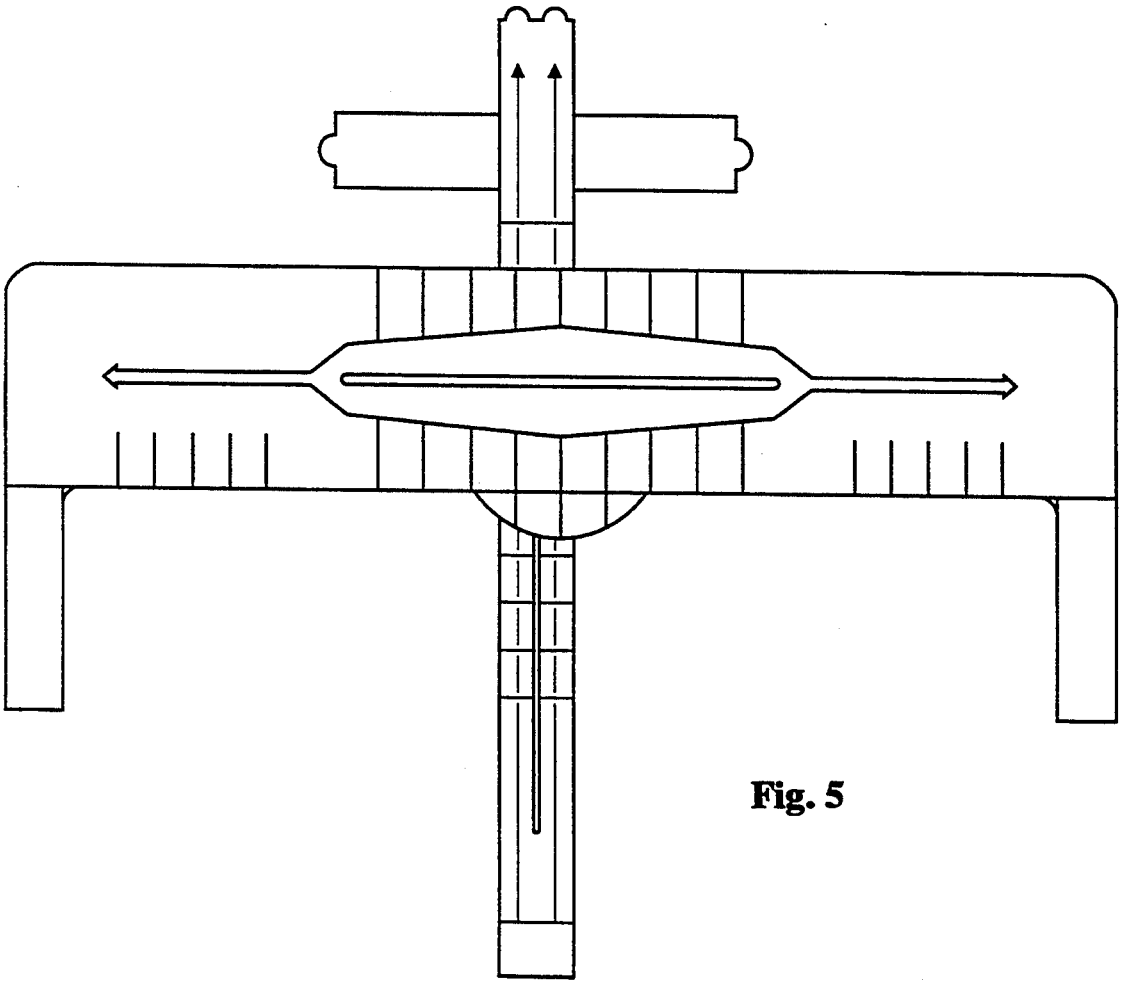
FIG. 5 is a plan view of the assembled invention illustrating a proper setup for a right-handed golfer to affect a shot with the short irons (8 and 9 irons).

FIGS. 3–5, in addition to illustrating proper setup of the pro-stance training tool 50 for particular shots, illustrate how the pro-stance training tool 50 appears when assembled. To assemble the training tool 50, the user simply has to lay the base plate 51 on top of the club selector guage 59 so that the slots 58 and 64 intersect. The user then inserts a bolt from underneath the club selector guage 60 and passing through both slots 58 and 64. The bolt is then secured by a wing nut. The target arrow 54 will be attached to the selection gauge during the manufacturing process, as discussed prior.

After assembly, the pro-stance training tool is ready for use. The only calculation that the golfer ever has to make is the measuring of his shoulder width. This measurement will change only as the golfer's shoulder width changes; therefore, this calculation must only be made periodically. Once the golfer has established his shoulder width, he is ready to affect any golf shot with the training tool 50. The first step in setting up the training tool 50 for a particular shot is the selection of the desired club. The golfer then adjusts the training tool 50 to the desired club setting by loosening the wing nut and sliding the club selector gauge 60 both vertically and horizontally with respect to the base plate 51 along slots 58 and 64.

For illustrative purposes, if a right-handed golfer wants to affect a three iron shot, he slides the club selector gauge 59 vertically until the horizontal club selector marking labelled THREE aligns with the outside edge of the base plate 51. He then slides the selector guage 59 horizontally, so that the left aligning line 63 on the selection gauge 60 lines up with the vertical right-handed club selector marking 56 on the base plate 51 that is labelled 3 WOOD LONG IRONS. The golfer then tightens the wing nut and the training tool 50 is properly adjusted. The training tool 50 is placed on the ground with the left target arrow 54 pointing toward the desired target. The golf ball is placed 3–4" away from the left ball pointer 61. The golfer then places his feet against the inside edge of the base plate 51 by lining his feet up with the appropriate foot placement indicators 52 as determined by his shoulder width. For example, if the golfer's shoulder width is 20", he places his left foot at the 20" indicator 52 on the left side of the base plate 51 and his right foot at the 20" indicator 52 on the right side of the base plate 51. Finally, the golfer sets down his club behind the golf ball and squares his toes and shoulders with the TOE AND SHOULDER LINE 53 on the base plate 51. The golfer is now assured that he is correctly aligned to affect a three iron shot. His feet and shoulders are parallel to the target line; the ball is properly spaced away from his body; and the ball is properly spaced between his right and left feet. Through repeated practice with the training tool in this position, the golfer will eventually be able to repeat this correct stance without use of the training tool.

FIG. 3 illustrates the setup described above—for a right-handed golfer to affect a long iron shot. FIGS. 4 and 5 illustrate the proper setup for a right-handed golfer to affect a mid-iron shot and a wedge shot respectively. The principles and setup of the present invention remain identical for left-handed golfers, except that left-handers simply use the appropriate indicators on the right side of the base plate 51 and club selector gauge 59.

I claim:

1. A new and improved golf stance training tool designed to insure a golfer's consistently correct stance in relation to both the ball to be struck and the desired target for every different golf club, comprising:

(a) a base plate in the shape of a non-adjustable arch bearing pre-calibrated foot placement indicia, as determined by a golfer's shoulder width, along with pre-calibrated club selection indicia representing correct club placement for each different club between those foot placement indicia for both right and left-handed golfers;

(b) a first club selector gauge member adjustably connected to said base plate and bearing pre-calibrated indicia representing the proper distancing of the golf ball away from the feet for each different golf club and having ball placement indicator arrows positioned on its top edge so as to not interfere with the clubhead path, said arrows being spaced apart and indicating proper ball placement for both right and left-handed golfers; and (c) a second target arrow pointer member being perpendicularly mounted to said first club selector gauge member so as to indicate the proper target line for both right and left-handed golfers.

2. The golf stance training tool described in claim 1 wherein said base plate and club selector gauge components are attached perpendicularly by means of a single wing nut-bolt assembly passed through slots on both components, which assembly can be loosened and retightened so as to allow horizontal as well as vertical movement of the first club selector gauge member in relation to the base plate for the aligning of the club selection indicia on the selector gauge with the corresponding indicia on the base plate.

* * * * *